US005492377A

United States Patent [19]

Guelck

[11] Patent Number: 5,492,377

[45] Date of Patent: Feb. 20, 1996

[54] WINDOW LOCK

[76] Inventor: Volker Guelck, 114 Columbia St. W., Waterloo, Ontario, Canada, N2L 3K8

[21] Appl. No.: 261,524

[22] Filed: Jun. 17, 1994

[51] Int. Cl.[6] ..... E05C 19/00

[52] U.S. Cl. ..... 292/2

[58] Field of Search ..... 292/95, 97, 196, 292/DIG. 20, DIG. 35, DIG. 47, DIG. 65, 200, 209

[56] References Cited

U.S. PATENT DOCUMENTS

| | | | |
|---|---|---|---|
| 2,281,947 | 5/1942 | Parsons | 292/341.17 |
| 2,829,912 | 4/1958 | Koch | 292/340 |
| 2,961,263 | 11/1960 | Ahlgren | 292/DIG. 20 X |
| 3,109,675 | 11/1963 | Anderson | 292/109 |
| 3,262,726 | 7/1966 | Phelps | 292/196 |
| 3,706,467 | 12/1972 | Martin | 292/DIG. 20 X |
| 4,095,827 | 6/1978 | Stavenau | 292/65 |
| 4,181,333 | 1/1980 | Stelma | 292/DIG. 20 X |

*Primary Examiner*—Steven N. Meyers
*Assistant Examiner*—Monica E. Millner
*Attorney, Agent, or Firm*—Panitch Schwarze Jacobs & Nadel

[57] ABSTRACT

A window lock includes a lock base fixed to a first window sash and a lock catch fixed to a second window sash. A lock casing is mounted for linear reciprocation on the lock base. A pivotal locking member is mounted on the lock base so as to selectively engage the lock catch. A linkage mechanism interconnects the lock casing with the pivotal locking member and transforms the linear reciprocation of the lock casing into pivotal reciprocal movements of the locking member. A safety mechanism is provided to selectively prevent accidental or unauthorized linear reciprocation of the lock casing. The lock casing substantially surrounds the lock base, the linkage mechanism, and the safety mechanism, thereby providing the window lock with an aesthetically pleasing appearance suitable for modern decors.

16 Claims, 5 Drawing Sheets

FIG. 4
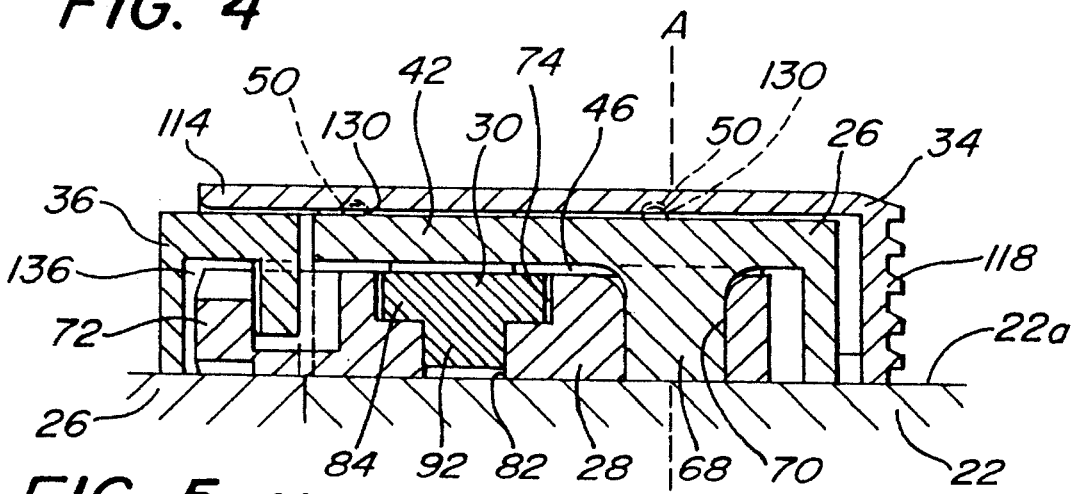
FIG. 5
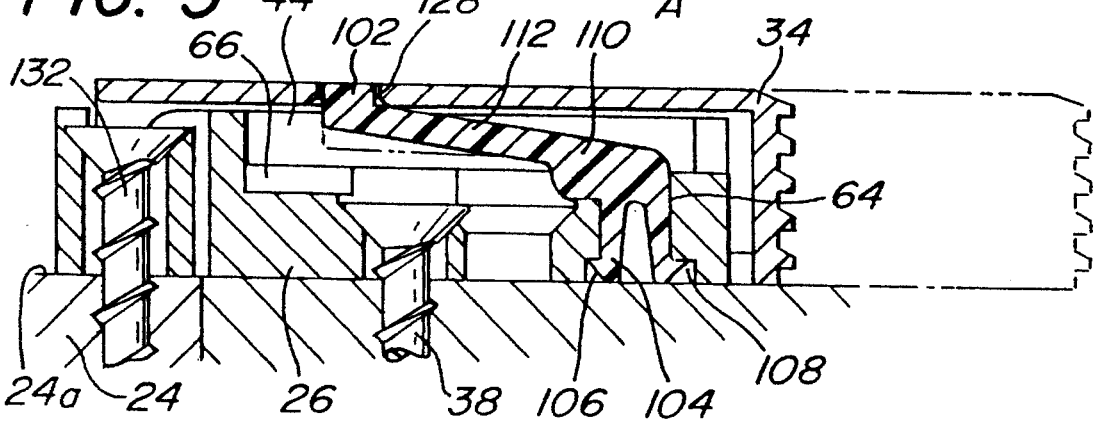
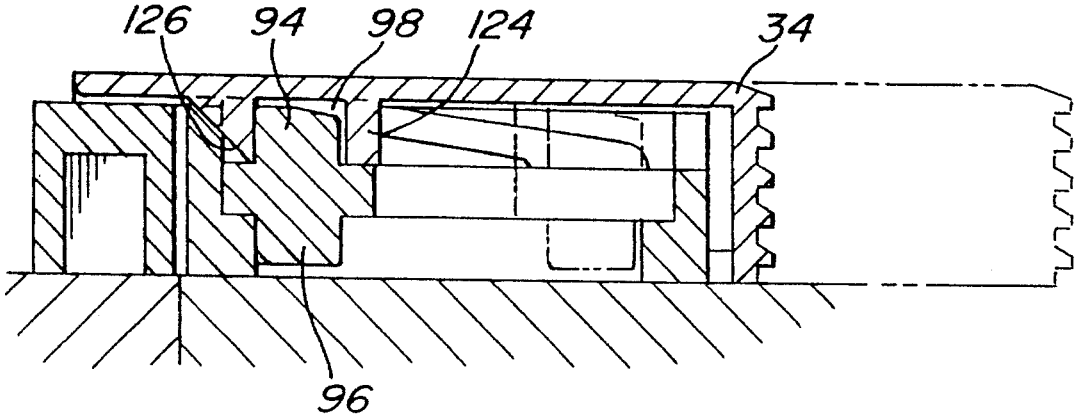
FIG. 6

WINDOW LOCK

FIELD OF THE INVENTION

The present invention relates to the field of window locks. More particularly, the present invention relates to the field of window locks for selectively locking a first window sash against movement relative to an adjacent second window sash.

BACKGROUND OF THE INVENTION

Various arrangements have been proposed for selectively locking a first window sash against movement relative to an adjacent second window sash. In one arrangement commonly employed for locking residential double hung windows, a manually actuated pivotal locking member is mounted on the lower window sash and is effective to selectively engage a lock catch mounted on the upper window sash. While such an arrangement is mechanically effective for achieving its intended purpose, its appearance is aesthetically undesirable in modern settings since both the pivotal locking member and lock catch are exposed to view.

Other attempts have been made to create locks for double hung windows which are aesthetically pleasing. One such attempt, partially surrounds the locking mechanism so that the majority of the internal components which make up the locking mechanism are screened from view. However, even this locking mechanism includes components which are exposed to view which are not aesthetically pleasing. Another type of window lock for double hung windows achieves the result of substantially covering the locking mechanism with a cover when in the locked position, but fails to adequately cover the locking mechanism when in the unlocked position and when moving between the locked and unlocked positions. Accordingly, the conventional mechanisms for locking double hung windows have not been completely aesthetically pleasing and, therefore, a need has arisen for a window lock which securely locks a double hung window and yet has a completely aesthetically overall pleasing appearance.

Furthermore, even where conventional window locks achieve a somewhat aesthetically pleasing appearance, they fail to include any mechanism which would prevent a child from unlocking the window lock. It is well-recognized that windows which are installed at significant heights above ground level are dangerous to small children when in the open position. Therefore, a need has arisen for a window lock which is resistant to a small child opening it without adult supervision. Such a window lock would significantly decrease the chances of a small child falling from an open window which is located significantly above ground level.

The present invention provides a window lock for locking a first window sash to an adjacent second window sash. The lock includes and actuating lock casing which substantially surrounds the internal mechanisms of the lock and is capable of linear reciprocal movement to control the lock. Since the lock casing substantially surrounds the internal components of the lock, it provides the lock with an overall aesthetically pleasing appearance. The present invention also includes a safety mechanism which assists in maintaining the window lock in the locked position.

SUMMARY OF THE INVENTION

Briefly stated, in one respect the invention is directed toward a window lock for locking a first window sash to an adjacent second window sash. The window lock includes a lock base for being fixed to the first window sash, a lock catch for being fixed to the second window sash, and a lock casing mounted on the lock base for reciprocal movement in a first plane between a first position and a second position. A locking member is mounted on the lock base for reciprocal movement in a second plane parallel to the first plane between a locking position in which the locking member interlocks with the lock catch and an unlocking position in which the locking member is disengaged from the lock catch, and a linkage mechanism interconnects the lock casing and the locking member to move the locking member from the locking position to the unlocking position as the lock casing is moved from the first position to the second position.

In another respect, the present invention is directed towards a window lock for locking a first window sash against movement relative to an adjacent second window sash. The window lock includes a lock base for being fixed to the first window sash, a lock catch for being fixed to the second window sash, and a lock casing mounted on the lock base for selective linear reciprocal movement. A locking member is mounted on the lock base for pivotal reciprocal movement about an axis to selectively engage the lock catch. A linkage mechanism interconnects the lock casing and the locking member to transform the linear reciprocal movement of the lock casing into the pivotal reciprocal movement of the locking member.

In yet another respect, the invention is directed toward a window lock for locking a first window sash to an adjacent second window sash. The window lock includes a lock base for being fixed to the first window sash, a lock catch for being fixed to the second window sash, and a locking member mounted on the lock base for reciprocal movement between a locking position in which the locking member interlocks with the lock catch and an unlocking position in which the locking member is disengaged from the lock catch. A lock casing is mounted on the lock base for linear reciprocal movement between a first position and a second position. The lock casing is interconnected with the locking member in such a manner that the linear reciprocal movement of the lock casing between the first and the second positions is effective to produce the reciprocal movement of the locking member between the locking and the unlocking positions. The lock casing is configured to substantially surround the lock base, the lock catch, and the locking member when the lock casing is in the first position.

BRIEF DESCRIPTION OF THE DRAWINGS

The foregoing summary, as well as the following detailed description of the presently preferred embodiment of the invention, will better be understood when read in conjunction with the appended drawings. For the purpose of illustrating the invention, there is shown in the drawings an embodiment of the invention which is presently preferred. It should be understood, however, that the present invention is not limited to the particular arrangements and instrumentalities shown. In the drawings:

FIG. 4 is a cross-sectional view of the window lock shown in FIG. 3 taken along lines 4—4 of FIG. 3;

FIG. 5 is a cross-sectional view of the window lock shown in FIG. 3 taken along lines 5—5 of FIG. 3;

FIG. 6 is a cross-sectional view of the window lock shown in FIG. 3 taken along lines 6—6 of FIG. 3.

DETAILED DESCRIPTION OF THE PREFERRED EMBODIMENT

Figure 1:
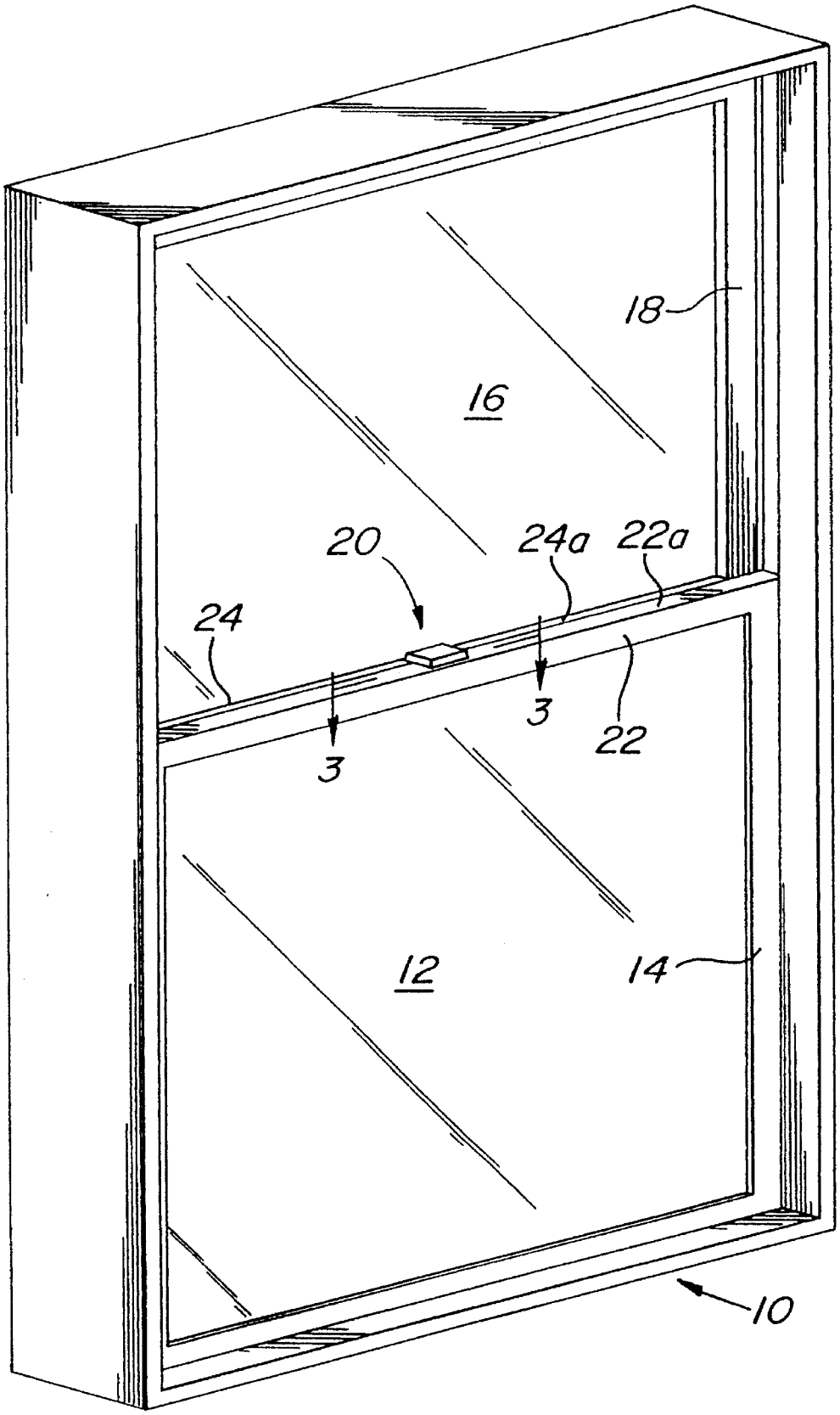
FIG. 1 is a front perspective of a double hung window employing a window lock in accordance with the present invention.

Referring now to the drawings in detail, wherein like numerals indicate like elements throughout, there is shown in FIG. 1 a double hung window assembly, indicated generally at 10, which employs a window lock 20 in accordance with the present invention. The double hung window assembly 10 includes a lower window 12 surrounded by a first window sash 14 and an adjacent upper window 16 surrounded by a second window sash 18. The first window sash 14 includes a top bar 22 having a substantially planar upper horizontal surface 22*a*, and the second window sash 18 includes a bottom bar 24 having a substantially planar upper horizontal surface 24*a*. As is conventional, the lower and upper windows 12, 16 are mounted on tracks (not shown) within the window assembly 10 and are capable of vertical reciprocal movements. As shown in FIG. 1, the window assembly 10 is configured such that, when the lower and upper windows 12, 16 are in their extreme lowered and raised positions, respectively, the upper horizontal surface 22*a* of the first window sash 14 is substantially coplanar with and lies closely adjacent to the upper horizontal surface 24*a* of the second window sash 18.

As shown in FIGS. 2 to 6, the window lock 20 preferably includes as its major components a lock base 26, a locking member 28, a connecting link 30, a resilient link 32, a lock casing 34, and a lock catch 36.

The lock base 26 is fixed to the upper horizontal surface 22*a* of the top bar 22 of the first window sash 14 by means of screws 38. In order to accommodate different sash widths, the lock base 26 is provided with a plurality of mounting hole sets 40, 40' (FIG. 2) for receiving the screws 38. According to the preferred embodiment, the screws 38 are received in only one of the mounting hole sets 40 or 40'.

While in the present embodiment it is preferred that the lock base 26 be secured to the first window sash 14 by a pair of screws 38, it is understood by those skilled in the art that the lock base 26 be secured to the first window sash 14 in other manners. For instance, the lock base 26 could be riveted to the first window sash 14, bolted to the first window sash 14, or adhesively secured to the first window sash 14 (not shown), without departing from the spirit and scope of the invention.

The lock base 26 takes the form of a generally rectangular block and includes an upper wall portion 42, an upper cavity 44, a lower cavity 46, and a pair of lateral guide recesses 48. The lock base 26 is preferably made from a high strength, lightweight material, such as zinc. However, it is understood by those skilled in the art, that the lock base 26 can be constructed of other materials, including polymeric materials such as nylon or polyvinylchloride, or metallic materials, such as aluminum or steel. Unless otherwise indicated herein, the remaining components of the window lock 20 are constructed of the same material as the lock base 26.

Figure 2:
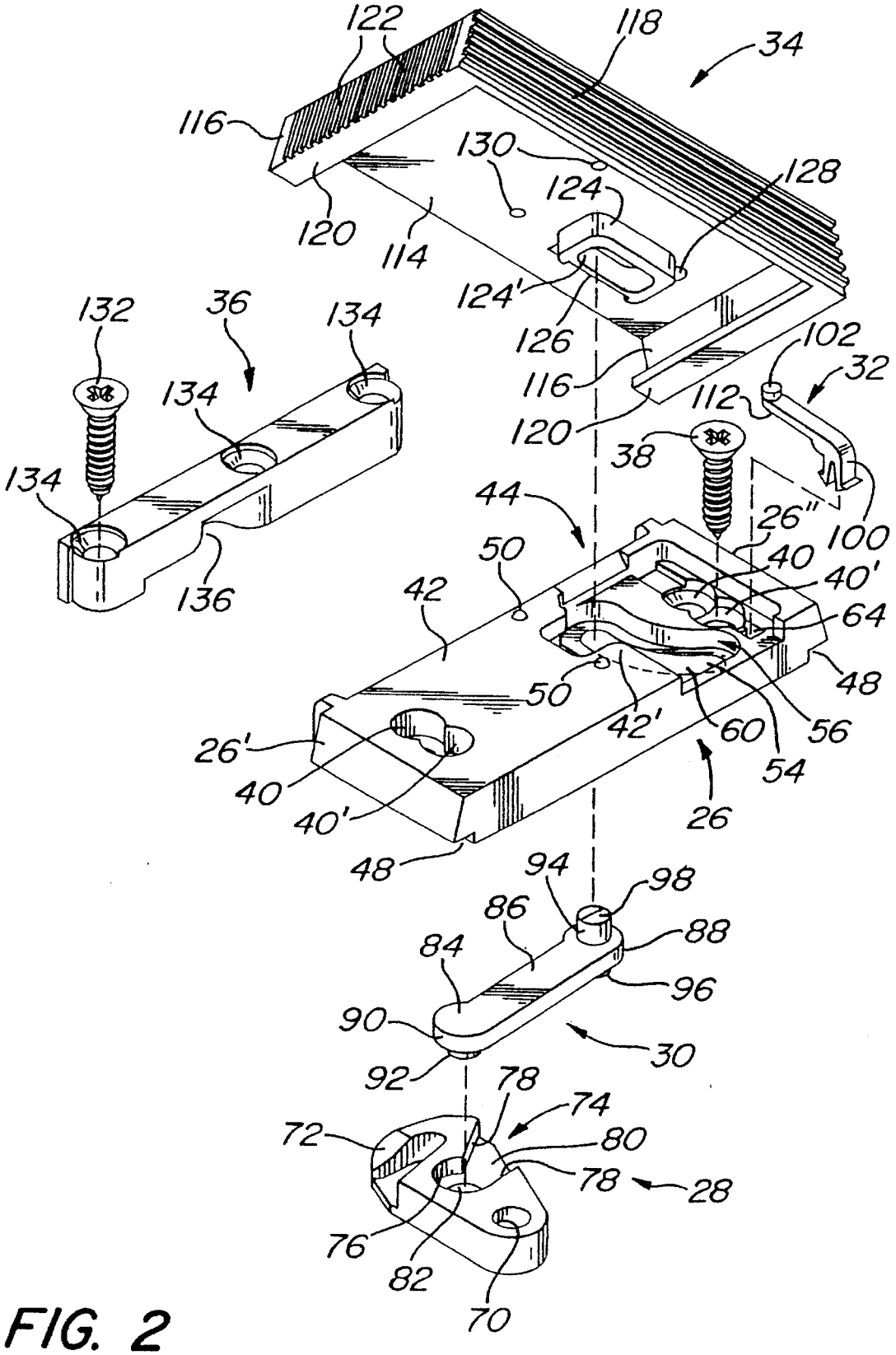
FIG. 2 is an exploded perspective view of the window lock shown in FIG. 1.

The upper wall portion 42 extends in a substantially horizontal direction across a portion of the lock base 26 and thus defines a plane which is substantially parallel to the plane of the upper horizontal surface 22*a* of the first window sash 14. As shown in FIGS. 2 and 4, the upper wall portion 42 is provided with a pair of detent projections 50.

As shown in FIGS. 2 and 5, the upper cavity 44 of the lock base 26 is formed laterally adjacent to the upper wall portion 42. The upper cavity 44 includes a cavity floor 52 and a recess 54 which extends below the cavity floor 52. The recess 54 defines a curved guideway 56 and a planar subfloor 58; a curved cam slot 60 is provided in the planar subfloor 58.

Figure 3:
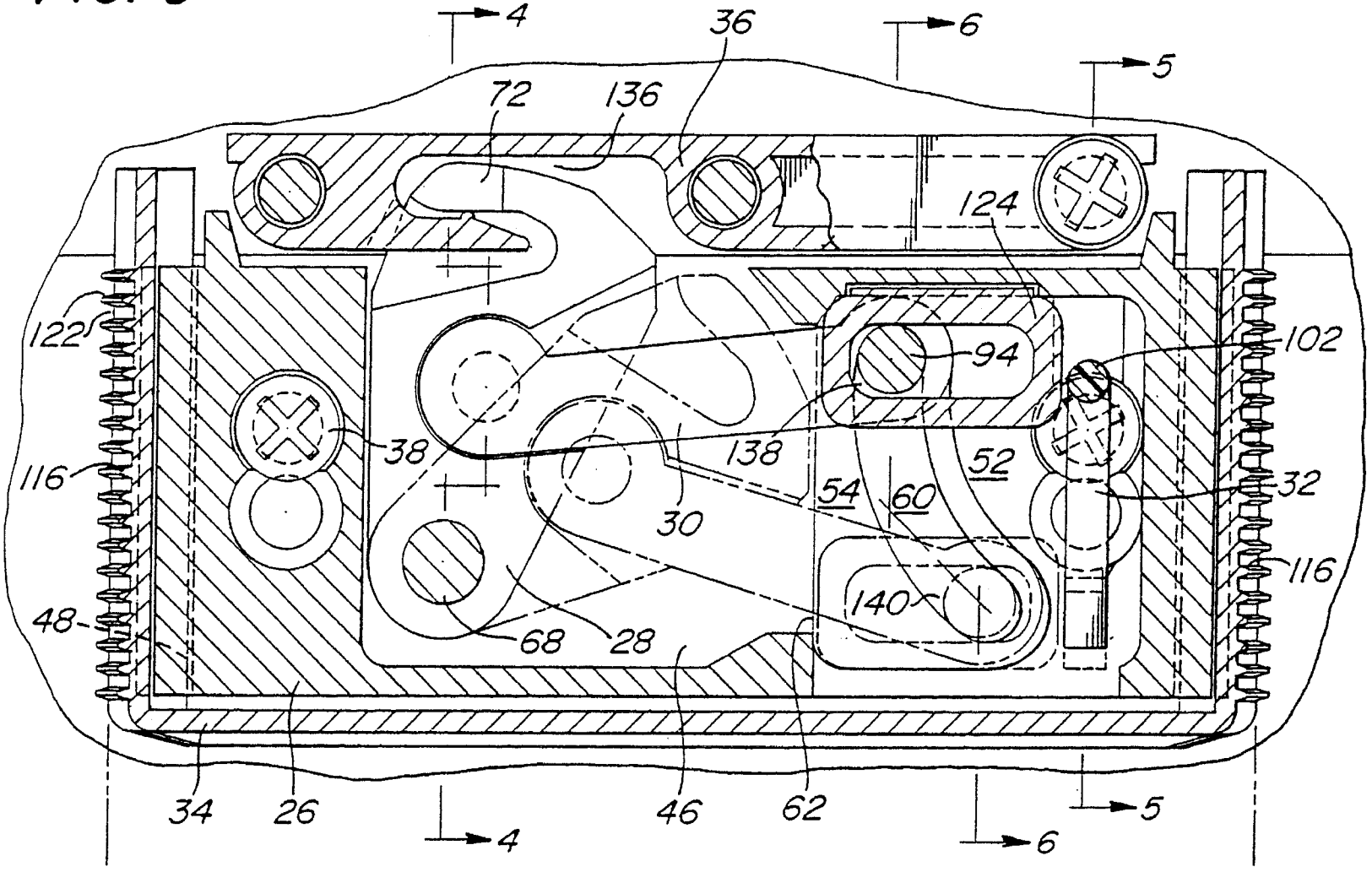
FIG. 3 is a cross-sectional view of the window lock shown in FIG. 1 taken along lines 3—3 of FIG. 1.

As shown in FIGS. 3 and 4, the lower cavity 46 is formed vertically beneath the upper wall portion 42, and the recess 54 intersects with the lower cavity 46 at an intersection zone 62 (FIG. 3) beneath a lateral edge 42' of the upper wall portion 42, thereby establishing a lateral passageway from the upper cavity 44 to the lower cavity 46. A mounting hole 64 extends from the upper cavity 44 entirely through the lock base 26, and a transverse groove 66 is provided in the cavity floor 52 and extends in a transverse direction away from the mounting hole 64.

As shown in FIGS. 2 and 3, the guide recesses 48 extend in parallel directions and together define a first plane which is substantially parallel to both the plane of the upper horizontal surface 22*a* of the first window sash 14 and the plane of the upper wall portion 42. In the preferred embodiment, the guide recesses 48 are formed as undercuts in the bottoms of the opposite lateral sides 26', 26" of the lock base 26. These undercuts cooperate with the upper horizontal surface 22*a* of the first window sash 14 to define groove-like linear guideways for the lock casing 34. The linear guideways slidably retain the lock casing 34 and enable the lock casing 34 to selectively undergo linear reciprocal movement relative to the lock base 26.

The locking member 28 is pivotally mounted within the lower cavity 46 on a pivot stub 68. As shown in FIG. 4, the pivot stub 68 depends generally perpendicularly from the upper wall portion 42 of the lock base 26 and is rotatably received within an aperture 70 provided at a first end of the locking member 28. The locking member 28 is thus mounted for pivotal reciprocation about an axis A of the pivot stub 68 and undergoes pivotal movement in a second plane which is orthogonal to the axis A and generally parallel to the first plane defined by the guide recesses 48. A hook portion 72 is provided at a second end of the locking member 28, and the locking member 28 is so configured as to be pivotable between a locking position (shown in solid lines in FIG. 3) in which the hook portion 72 extends beyond the confines of the lower cavity 46 and interlocks with the lock catch 36 and an unlocking position (shown in phantom in FIG. 3) in which the hook portion 72 is disposed substantially fully within the lower cavity 46. A recess 74 is provided at a midsection of the locking member 28 intermediate the aperture 70 and the hook portion 72. The recess 74 includes a partially-cylindrical wall portion 76, diverging lateral wall portions 78, and a planar base portion 80. A circular aperture 82 extends from the planar base portion 80 through the midsection of the locking member 28; the circular aperture 82 is coaxial with the partially-cylindrical wall portion 76.

The connecting link 30 is interconnected between the lock casing 34, the locking member 28, and the lock base 26 in such a manner as to define a linkage mechanism which transforms the linear reciprocal movement of the lock casing 34 relative to the lock base 26 into the pivotal reciprocal movement of the locking member 28. More particularly, the connecting link 30 includes a first end 84, a middle portion 86, and a second end 88. The first end 84 is disposed within the lower cavity 46 of the lock base 28 and includes a part cylindrical periphery 90 and a cylindrical projection 92. As shown in FIGS. 2 and 4, the first end 84 is pivotally received in the recess 74 provided in the midsection of the locking member 28 in such a manner that the cylindrical projection 92 is journalled within the circular aperture 82 and the part-cylindrical periphery 90 is complimentarily received within the part-cylindrical wall portion 76. The middle portion 86 of the connecting link 30 extends through the intersection zone 62 and into the recess 54 provided in the upper cavity 44. The second end 88 of the connecting link 30 is provided with a guide pin that defines upper and lower guide pin portions 94, 96, respectively. The second end 88 of the connecting link 30 is slidably supported on the planar subfloor 58 of the recess 54 adjacent to the curved guideway 56, and the lower guide pin portion 96 is slidably received within and guided along the curved cam slot 60. The upper guide pin portion 94 advantageously includes a forward facing tapered surface 98.

Referring now to in FIG. 2, the lock casing 34 includes a substantially planar upper wall 114, a pair of side walls 116 which depend downwardly from the upper wall 114, and a front wall 118 which depends downwardly from the upper wall 114 and which interconnects the side walls 116. The side walls 116 are provided at their distal ends with lateral retention flanges 120 which are slidably received within and guided along the guide recesses 48 formed at the bottom of the lock base 26. The lock casing 34 is thus slidably mounted on the lock base 26 for selective linear reciprocal movement relative to the lock base 26 in the first plane generally defined by the guide recesses 48.

The external surfaces of the side walls 116 and front walls 118 are provided with grip increasing textures, such as indicated at 122. In the preferred embodiment, the grip increasing textures take the form of alternating ridges and troughs; however it is envisioned that knurling or surface roughening may also be employed to provide such textures.

The lock casing 34 further includes a generally rectangular boss 124 which depends downwardly from a central portion of the upper wall 114 and extends into the upper cavity 44 formed in the lock base 28. A substantially straight guide slot 124' is defined within the boss 124. The guide slot 124' slidably receives and guides the upper guide pin portion 94 of the connecting link 30. A rear portion of the boss 124 is provided with a ramp surface 126 (FIG. 6) which is adapted to cooperate with the tapered surface 98 of the connecting link 30 to facilitate assembly of the window lock 20, as described in more detail hereinafter. As shown in FIGS. 2 and 4, detent recesses 130 are formed in the upper wall 114 of the lock casing 34 for releasably receiving the detent projections 50 provided on the upper wall portion 42 of the lock base 26.

In the present embodiment, it is preferred that the lock casing 34 be constructed of polymeric material such as nylon. By constructing the lock casing 34 of nylon, the color of the lock casing 34 can be selected to complement the color of the window casing and frame to provide an overall aesthetically pleasing window. While in the present embodiment it is preferred that the lock casing 34 be constructed of polymeric material, it is understood by those skilled in the art that other materials could be used to construct the lock casing 34, such as zinc, aluminum, polyvinylchloride, brass, or other suitable materials, without departing from the spirit and scope of the invention.

The resilient link 32 constitutes a child-safety mechanism which selectively interconnects the lock base 26 and the lock casing 34 in such a manner as to prevent the reciprocal movement of the lock casing 34 relative to the lock base 26. As shown in FIGS. 2 and 5, the resilient link 32 includes an anchoring portion 100 which is securely coupled to the lock base 26 and a registering portion 102 which is selectively coupleable to the lock casing 34. The anchoring portion 100 includes a pair of resilient legs 104 having tapered feet 106. The tapered feet 106 are adapted to slide through the mounting hole 64 in the lock base 26 upon assembly. Thereafter, the tapered feet 106 seat against a downward facing ledge 108 provided at a lower portion of the mounting hole 64, thereby clamping a body portion 110 of the resilient link 32 to the lock base 26. The registering portion 102 is connected to the body portion 110 by an integrally formed flexible portion 112; the flexible portion 112 is adapted to extend along and be received by the transverse groove 66 formed in the upper cavity 44.

Figure 7:
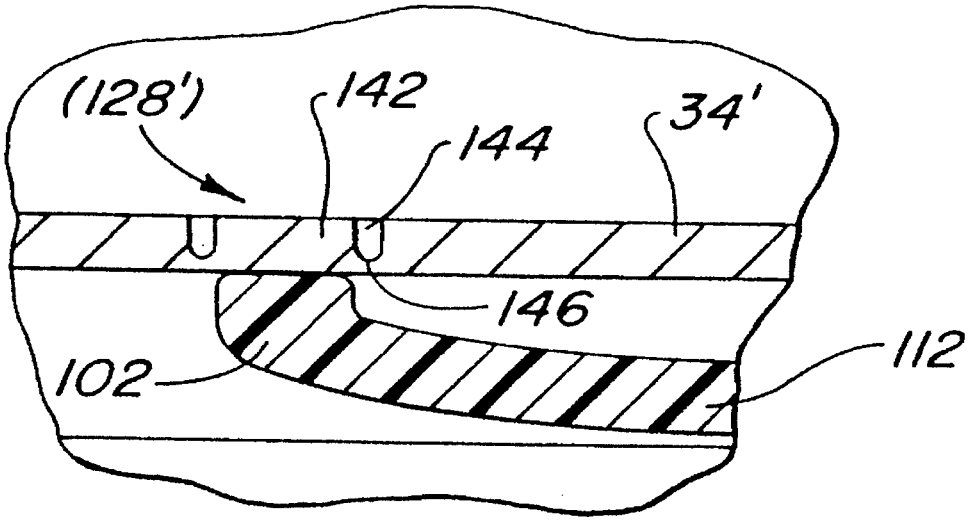
FIG. 7 is a partial cross-sectional view of a lock casing and resilient link according the present invention.

A registering aperture 128 is provided in the lock casing 34 adjacent to the guide slot 124' and is arranged to selectively receive the registering portion 102 of the resilient link 32. More particularly, as shown in FIG. 7, the modified lock casing 34' is provided with an integral knock-out plug 142; the knock-out plug 142 is initially positioned within the registering aperture 128. An annular or substantially annular channel 144 is formed in the lock casing 34' and surrounds the knock-out plug 142. One or more relatively thin connecting webs 146 are formed integrally with the lock casing 34' and structurally interconnect the knock-out plug 142 and the lock casing 34'.

When the lock casing 34' is in the first position (corresponding to the position shown in full lines in FIGS. 3, 4, and 6), the registering portion 102 of the resilient link 32 is resiliently urged into engagement with the knock-out plug 142 by means of the inherent resiliency of the flexible portion 112. However, due to the presence of the knock-out plug 142, the registering portion 112 does not positively engage the lock casing 34'. Accordingly, the resilient link 32 is incapable of preventing reciprocal movement of the lock casing 34' relative to the lock base 26, and the child-safety mechanism is therefore not enabled. In this condition, manual reciprocation of the lock casing 34' is effected merely by grasping the side walls 116 of the lock casing 34 and applying an appropriate pulling or pushing force in the direction of the guide recesses 48.

If a user desires to enable the child-safety mechanism, it is necessary only to remove the knock-out plug 142 from the lock casing 34' using a conventional tool, such as phillips head screw driver (not shown). Upon removal of the knock-out plug 142, the registering portion 102 is urged into a registering aperture 128' defined by the annular channel 144 and the broken web or webs 146 by means of the inherent resiliency of the flexible portion 112.

While in the present embodiment it is preferred that the window lock 20 include the knock-out plug 142 for permitting the end user to decide whether the use of the child-safety mechanism is desired, it is understood by those skilled in the art that the window lock 20 could be manufactured without the knock-out plug 142 in the registering aperture 128 such that all of the window locks 20 will include the child-safety mechanism. Furthermore, it is also understood by those skilled in the art that the registering aperture 128 and the resilient link 32 could be omitted entirely so that the window lock 20 does not include a child-safety mechanism, without departing from the spirit and scope of the invention.

As shown in FIGS. 2 and 5, the lock catch 36 is fixed to the upper horizontal surface **24*a* of the bottom bar 24 of the second window sash 16. The relative positions of the lock base 26 and the lock catch 36 on the respective window sashes 14, 18 are selected so that, when the lower and upper windows 12, 16 are in their extreme lowered and raised positions, respectively, the lock base 26 lies closely adjacent to the lock catch 36. In the preferred embodiment, the lock catch 36 is fixed to the upper horizontal surface 24***a* of the second window sash 16 by means of screws 132 received within mounting holes 134 provided in the lock catch 36, although other fastening methods could be used, such as those described above in connection with the lock base 26. The lock catch 36 includes a locking member retention cavity 136 which lies closely adjacent to the lower cavity 46 formed in the lock base 26. The locking member retention cavity 136 is configured to selectively receive and retain the hook portion 72 of the locking member 28 when the locking member 28 is in its locking position.

Operation of the window lock 20 according to the preferred embodiment of the invention is described below.

When the lock casing 34 is in a first position shown in solid lines in FIGS. 3 to 6, the detent projections 50 on the lock base 26 are releasably received by the detent recesses 130 in the lock casing 34, and the major components of the window lock 20 cooperate to effectively lock the first window sash 14 against movement relative to the adjacent second window sash 18, as shown in FIGS. 1 and 3. That is, the guide slot 124' in the lock casing 34 and the curved cam slot 60 in the lock base 26 together constrain the guide pin in the second end 88 of the connecting link 30 to assume a first lateral position 138 (FIG. 3) relative to the lock base 26 in which the lower guide pin portion 96 is received by a first end portion of the curved cam slot 60. (As shown in FIG. 3, the first end portion of the cam slot 60 extends in a direction substantially perpendicularly to the direction of extension of the guide slot 124'.) The connecting link 30 is thus constrained to the lateral position shown in solid lines in FIG. 3 and, in turn, constrains the locking member 28 to its locking position, also shown in full lines in FIG. 3. In the locking position, the hook portion 72 extends beyond the confines of the lower cavity 46 and enters the hook retention cavity 136 provided in the lock catch 36, thereby interlocking the locking member 28 with the lock catch 36. Accordingly, when the lock casing 34 is in the first position, the locking member 28 effectively interconnects the lock base 26 and the lock catch 36, thus locking the window lock 20 and preventing movement of the first window sash 14 relative to the second window sash 18.

Moreover, when the lock casing 34 is in the first position, all of the other major components of the window lock 20 (including the lock base 26, the locking member 28, the connecting link 30, resilient link 32, and the lock catch 36) are surrounded by or substantially surrounded by the lock casing 34. In this position, as shown in FIGS. 1, 3 and 4, the upper wall 114 of the lock casing 34 substantially covers the lock catch 36, while the distal ends of the side walls 116 of the lock casing 34 remain in close proximity to the upper horizontal surface 22*a* of the first window sash 14. As such, the entire window lock 20 presents a clean and uncluttered appearance which is both aesthetically pleasing.

In order to effect disengagement of the locking member 28 from the lock catch 36, the lock casing 34 is adapted to be manually reciprocated between the first position and a second position shown in dashed lines in FIGS. 3, 5, and 6. The manual reciprocation of the lock casing 34 is effected by first releasing the resilient link 32 from engagement with the lock casing 34 and thereafter grasping the side walls 116 of the lock casing 34 and applying an appropriate pulling force in the direction away from the window 10, thereby causing the detent projections 50 on the lock base 26 to become released from the detent recesses 130 provided in the lock casing 134.

The resilient link 32 and its associated connections to the lock base 26 and the lock casing 34 as shown in FIG. 5 constitute the child-safety mechanism according to the preferred embodiment and prevent accidental or unauthorized reciprocation of the lock casing 34 from the first position. As shown in FIG. 5, the registering portion 102 of the resilient link 32 is normally urged into engagement (or registry) with the registering aperture 128 provided in the lock casing 34 by means of both the inherent resiliency of the flexible portion 112 of the resilient link 32 and the manner in which the resilient link is securely coupled to (e.g. anchored in) the lock base 26. Accordingly, in the absence of external forces applied to the registering portion 102, the registering portion 102 will normally assume a position within the registering aperture 128, thereby positively coupling the resilient link 32 to the lock casing 34. In this position, the resilient link 32 establishes an interconnection between the lock base 26 and the lock casing 34 and functions as a force transmitting member which effectively prevents reciprocal movement of the lock casing 34 relative to the lock base 26.

In order to release the resilient link 32 from engagement with the lock casing 34, it is necessary merely to press down on the registering portion 102 (as with a pen or pencil tip) in order to overcome the inherent resiliency of the flexible portion 112 and thereby cause the resilient link 32 to assume the position indicated by dashed lines in FIG. 5 in which the registering portion 102 is disengaged from (e.g. out of registry with) the registering aperture 128. In this position, the resilient link 32 is released from engagement with the lock casing 34, and the lock casing 34 is free to be grasped and manually reciprocated to the second position shown in dashed lines in FIGS. 3, 5, and 6.

Upon manual reciprocation of the lock casing 34 to the second position, the upper and lower guide pin portions 94, 96 in the second end 88 of the connecting link 30 are constrained to slide within the guide slot 124' and the curved cam slot 60, respectively, and ultimately cause the second end 88 of the connecting link 30 to assume a second lateral position 140 (shown in phantom in FIG. 3) relative to the lock base 26 in which the lower guide pin portion 96 is received by a second end portion of the curved cam slot 60. As the second end 88 moves towards the second lateral position 140, the connecting link 30 undergoes combined lateral and pivotal movement and forces the locking lever 28 to undergo pivotal movement from the locking position toward the unlocking position shown in phantom in FIG. 3. In the unlocking position, the hook portion 72 of the locking member 28 is disposed substantially fully within the lower cavity 46. Therefore, when the lock casing 34 is reciprocated to the second position, the locking member 28 retracts into the lower cavity 46 and thus becomes disengaged from the lock catch 36, thereby unlocking the window lock 20 and permitting relative movement between the first and second window sashes 14, 18.

In order to relock the window lock 20, it is necessary only to manually reciprocate the lock casing 34 back to the first position by grasping the lock casing 34 and applying an appropriate pushing force in the direction of the guide recesses 48. As the lock casing 34 reassumes the first position, the registering portion 102 of the resilient link 32 automatically snaps back into the registering aperture 128.

Assembly of the window lock 20 according to the preferred embodiment of the invention is described below.

Initially, the locking member 28 and the connecting link 30 are operatively assembled to the lock base 26 in such a manner that the lower guide pin portion 96 of the connecting link 30 is disposed in the curved cam slot 60. This is accomplished e.g. by passing the first end 84 of the connecting link 30 through the intersection zone 62 and into the lower cavity 46, and thereafter mounting the locking member 28 to the pivot stub 68. The resilient link 32 is also operatively assembled to the lock base 26. Then, the lock base 26 is fixed to the first window sash 14, and the lock catch 36 is fixed to the second window sash 18 using the screws 38, 132, respectively. Next the lock casing 34 is slid onto the lock base 26 in such a manner that the lateral flanges 120 of the side walls 116 are received within the guide recesses 48 provided in the lock base 26. As the lock casing 34 is being slid onto the lock base 26, the tapered surface 98 of the upper guide pin portion 94 engages and begins to slide along the ramp surface 126 of the annular boss 124. As the upper guide pin portion 94 slides along the ramp surface 126, a slight deformation of the lock casing 34 occurs which permits the upper guide pin portion 94 to approach and then snap into the guide slot 124' in the lock casing 34, thereby completing the assembly of the window lock 20.

From the foregoing description, it can be seen that the preferred embodiments of the invention comprise a window lock which is operative to selectively lock a first window sash to an adjacent second window sash. It will be appreciated, however, that changes and modifications may be made to the above described embodiments without departing from the inventive concept thereof. For example, the pivot stub 68 need not be formed integrally with the lock casing 34 but may instead be formed from a suitable low friction bearing material and attached to the lock casing 34. The upper and lower guide pin portions 94, 96 need not be formed integrally with the connecting link 30 and need not comprise portions of a single guide pin but may instead be separately formed from a suitable low friction bearing material and attached to the connecting link 30. The lateral retention flanges 120 need not extend continuously along the entire length of the side walls 116 and may each comprise a plurality of discrete lateral projections. The linkage mechanism need not comprise a single connecting link 30, but may (for example) comprise two or more connecting links. Therefore, it is understood that the present invention is not limited to the particular embodiment disclosed, but is intended to include all modifications and changes which are within the scope and spirit of the invention as defined by the appended claims.

What is claimed is:

1. A window lock for locking a first window sash to an adjacent second window sash, the window lock comprising:

a lock base for being fixed to the first window sash;

a lock catch for being fixed to the second window sash;

a lock casing mounted on the lock base for reciprocal movement in a first plane between a first position, in which the lock casing substantially surrounds the lock base, a locking member, and a linkage mechanism , and a second position, in which the lock base is partially exposed, the lock casing includes a pair of side walls which depend downwardly from opposing sides of an upper wall, and wherein distal ends of the side walls are disposed in close proximity to the first window sash so as to substantially surround the lock base, the locking member, and the linkage mechanism when the lock casing is in the first position, and each of the side walls includes a lateral retention flange which is received within a guide recess formed in the lock base;

the locking member mounted on the lock base for reciprocal movement in a second plane parallel to the first plane between a locking position in which the locking member interlocks with the lock catch and an unlocking position in which the locking member is disengaged from the lock catch; and the linkage mechanism interconnected between the lock casing and the locking member for moving the locking member from the locking position to the unlocking position as the lock casing is moved from the first position to the second position.

2. The window lock as recited in claim 1, wherein the side walls are provided with grip increasing textures.

3. The window lock as recited in claim 1, wherein a locking member retention cavity is formed within the lock catch, and wherein the locking member includes a hook portion which is disposed within the locking member retention cavity when the locking member is in the locking position.

4. A window lock for locking a first window sash to an adjacent second window sash, the window lock comprising:

a lock base for being fixed to the first window sash;

a lock catch for being fixed to the second window sash;

a lock casing mounted on the lock base for reciprocal movement in a first plane between a first position, in which the lock casing substantially surrounds the lock base, and a second position, in which the lock base is partially exposed;

a cam slot formed in the lock base and a guide slot overlying the cam slot formed in the lock casing;

a locking member pivotally mounted on the lock base for reciprocal movement in a second plane parallel to the first plane between a locking position in which the locking member interlocks with the lock catch and an unlocking position in which the locking member is disengaged from the lock catch;

a linkage mechanism interconnected between the lock casing and the locking member for moving the locking member from the locking position to the unlocking position as the lock casing is moved from the first position to the second position, the linkage mechanism including a connecting link having a first end and a second end, the first end of the connecting link being pivotally connected to the locking member, and the second end of the connecting link including a guide pin which is slidably received within both the cam slot and the guide slot.

5. The window lock as recited in claim 4, wherein the cam slot is curved and includes a first portion which receives the guide pin when the lock casing is in the first position and a second portion which receives the guide pin when the lock casing is in the second position.

6. The window lock as recited in claim 5, wherein the guide slot is substantially straight, and wherein a direction of extension of the guide slot is substantially perpendicular to a direction of extension of the first portion of the cam slot.

7. A window lock for locking a first window sash to an adjacent second window sash, the window lock comprising:

a lock base for being fixed to the first window sash;

a lock catch for being fixed to the second window sash;

a lock casing mounted on the lock base for reciprocal movement in a first plane between a first position, in which the lock casing substantially surrounds the lock base, and a second position, in which the lock base is partially exposed;

a locking member mounted on the lock base for reciprocal movement in a second plane parallel to the first plane between a locking position in which the locking member interlocks with the lock catch and an unlocking position in which the locking member is disengaged from the lock catch;

a linkage mechanism interconnected between the lock casing and the locking member for moving the locking member from the locking position to the unlocking position as the lock casing is moved from the first position to the second position; and a safety mechanism extending between the lock base and the lock casing for selectively preventing the reciprocal movement of the lock casing relative to the lock base when the lock casing is in the first position.

8. The window lock as recited in claim 7, wherein the safety mechanism includes a force transmitting member which is securely coupled to the lock base and selectively coupleable to the lock casing.

9. The window lock as recited in claim 8, wherein an aperture is provided in the lock casing and a portion of the force transmitting member is adapted to be selectively urged into engagement with the aperture when the lock casing is in the first position, thereby coupling the force transmitting member to the lock casing.

10. The window lock as recited in claim 9, wherein the force transmitting member is a resilient link which is adapted to be urged into engagement with the aperture through its own resiliency.

11. The window lock as recited in claim 8, wherein an aperture is provided in the lock casing and a portion of the force transmitting member is normally resiliently urged into engagement with the aperture when the lock casing is in the first position, the portion of the force transmitting member being selectively releasable from engagement with the aperture by manually overcoming the resilient force.

12. The window lock as recited in claim 8, wherein an aperture with an integral knock-out plug is provided in the lock casing and a portion of the force transmitting member is resiliently urged into engagement with the knock-out plug when the lock casing is in the first position, the portion of the force transmitting member being selectively engageable with the aperture upon removal of the knock-out plug.

13. A window lock for locking a first window sash against movement relative to an adjacent second window sash, the window lock comprising:

a lock base for being fixed to the first window sash;

a lock catch for being fixed to the second window sash;

a lock casing mounted on the lock base for selective linear reciprocal movement;

a cam slot formed in the lock base and a guide slot overlying the cam slot formed in the lock casing;

a locking member mounted on the lock base for pivotal reciprocal movement about an axis to selectively engage the lock catch; and a linkage mechanism interconnected between the lock casing and the locking member for transforming the linear reciprocal movement of the lock casing into the pivotal reciprocal movement of the locking member, the linkage mechanism including a connecting link having a first end and a second end, the first end of the connecting link being pivotally connected to the locking member, and the second end of the connecting link including a guide pin which is slidably received within both the cam slot and the guide slot.

14. A window lock for locking a first window sash against movement relative to an adjacent second window sash, the window lock comprising:

a lock base for being fixed to the first window sash;

a lock catch for being fixed to the second window sash;

a lock casing mounted on the lock base for selective linear reciprocal movement;

a locking member mounted on the lock base for pivotal reciprocal movement about an axis to selectively engage the lock catch;

a linkage mechanism interconnected between the lock casing and the locking member for transforming the linear reciprocal movement of the lock casing into the pivotal reciprocal movement of the locking member; and a safety mechanism extending between the lock base and the lock casing for selectively preventing the reciprocal movement of the lock casing relative to the lock base.

15. A window lock for locking a first window sash to an adjacent second window sash the window lock comprising:

a lock base for being fixed to the first window sash;

a lock catch for being fixed to the second window sash;

a locking member mounted on the lock base for reciprocal movement between a locking position in which the locking member interlocks with the lock catch and an unlocking position in which the locking member is disengaged from the lock catch; and a lock casing mounted on the lock base for linear reciprocal movement between a first position, in which the lock casing substantially surrounds the lock base, and a second position, in which the lock base is partially exposed, the lock casing being interconnected with the locking member in such a manner that the linear reciprocal movement of the lock casing between the first and the second positions is effective to produce the reciprocal movement of the locking member between the locking and the unlocking positions, the lock casing includes a pair of side walls which depend downwardly from opposing sides of an upper wall, and wherein distal ends of the side walls are disposed in close proximity to the first window sash so as to substantially surround the lock base, the lock catch, and the locking member when the lock casing is in the first position, each of the side walls includes a lateral retention flange which is received within a guide recess formed in the lock base.

16. The window lock as recited in claim 15, further comprising:

a linkage mechanism interconnected between the lock casing and the locking member for moving the locking member from the locking position to the unlocking position as the lock casing is moved from the first position to the second position.

* * * * *